United States Patent [19]

Tenhover et al.

[11] Patent Number: 4,705,610

[45] Date of Patent: Nov. 10, 1987

[54] ANODES CONTAINING IRIDIUM BASED AMORPHOUS METAL ALLOYS AND USE THEREOF AS HALOGEN ELECTRODES

[75] Inventors: Michael A. Tenhover, Solon; Jonathan H. Harris, Shaker Heights; Robert K. Grasselli, Aurora, all of Ohio

[73] Assignee: The Standard Oil Company, Cleveland, Ohio

[21] Appl. No.: 867,782

[22] Filed: May 27, 1986

Related U.S. Application Data

[63] Continuation-in-part of Ser. No. 747,996, Jun. 24, 1985, abandoned.

[51] Int. Cl.[4] ..... C25B 1/24

[52] U.S. Cl. ..... 204/95; 204/98; 204/128; 204/290 R; 204/290 F; 204/192.15; 204/192.17; 204/192.23; 204/192.31

[58] Field of Search ..... 204/98, 128, 290 R, 204/293, 192.15, 192.17, 192.23, 192.31; 148/403

[56] References Cited

U.S. PATENT DOCUMENTS

| | | | |
|---|---|---|---|
| 3,234,110 | 2/1966 | Beer | 204/38 |
| 3,236,756 | 2/1966 | Beer | 204/98 |
| 3,711,385 | 1/1973 | Beer | 204/59 |
| 3,853,739 | 12/1974 | Kolb et al. | 204/290 F |
| 3,856,513 | 12/1974 | Chen et al. | 75/123 B |
| 4,036,638 | 7/1977 | Ray et al. | 75/123 B |
| 4,339,270 | 7/1982 | Hashimoto et al. | 204/293 |
| 4,498,962 | 2/1985 | Oda et al. | 204/129 |
| 4,544,473 | 10/1985 | Ovshingsky et al. | 204/292 |
| 4,560,454 | 12/1985 | Harris et al. | 204/293 |

FOREIGN PATENT DOCUMENTS

| | | | |
|---|---|---|---|
| 0105453 | 8/1981 | Japan | 148/403 |
| 0105454 | 8/1981 | Japan | 148/403 |
| 0150148 | 11/1981 | Japan | 148/403 |
| 0107439 | 6/1983 | Japan | 148/403 |
| 2023177 | 12/1979 | United Kingdom | 204/293 |
| 2146660A | 4/1985 | United Kingdom . | |

OTHER PUBLICATIONS

"The Anodic Polarization Behavior of Amorphous Pd-Ti-P Alloys in NaCl Solutions" *Electrochimica Acta*, 25, pp. 1215-1220 (1980).

"Anodic Characteristics of Amorphous Ternary Palladium-Phosphorus Alloys Containing Ruthenium, Rhodium, Iridium or Platinum in a Hot Concentrated Sodium Chloride Solution" *Journal of Applied Electrochemistry*, 13, pp. 295-306 (1983).

"Anodic Characteristics of Amorphous Palladium-Iridium-Phosphorus Alloys in a Hot Concentrated Sodium Chloride Solution" *Journal of Non-Crystalline Solids*, 54, pp. 85-100 (1983).

*Primary Examiner*—John F. Niebling
*Assistant Examiner*—Kathryn Rubino
*Attorney, Agent, or Firm*—Joseph G. Curatolo; Larry W. Evans

[57] ABSTRACT

Anodes comprising substrate materials coated with iridium based amorphous metal alloys having the formulae $$Ir_iD_dE_eF_f$$

and $$Ir_iY_yD_dE_eF_f$$

where
Y is yttrium
D is Ti, Zr, Y, Nb, Ta, Ru, W, Mo and mixtures thereof;
E is C, B, Si, P, Al, Ge, As, N, Sb and mixtures thereof;
F is Rh, Pt, Pd and mixtures thereof;
i is 35 to 96 or 50 to 96, respectively;
y is 4 to 40;
d is 0 to 40;
e is 4 to 40;
f is 0 to 45; and
$i+d+e+f=100$, $i+y+d+e+f=100$, and if E is Si and/or P, then B is also present.

A process for the use of the foregoing iridium based alloys as anodes for the electrolysis of halide-containing electrolyte solutions is also provided.

22 Claims, No Drawings

ANODES CONTAINING IRIDIUM BASED AMORPHOUS METAL ALLOYS AND USE THEREOF AS HALOGEN ELECTRODES

CROSS-REFERENCE TO RELATED APPLICATION

This application is a continuation-in-part of U.S. Pat. Ser. No. 747,996, filed June 24, 1985 now abandoned.

TECHNICAL FIELD

The present invention is directed toward anodes containing amorphous metal alloys which can be considered metallic and are electrically conductive. Amorphous metal alloy materials have become of interest in recent years due to their unique combinations of mechanical, chemical and electrical properties which are specially well suited for newly emerging applications. Amorphous metal materials have compositionally variable properties, high hardness and strength, flexibility, soft magnetic and ferroelectronic properties, very high resistance to corrosion and wear, unusual alloy compositions, and high resistance to radiation damage. These characteristics are desirable for applications such as low temperature welding alloys, magnetic bubble memories, high field superconducting devices and soft magnetic materials for power transformer cores.

Given their resistance to corrosion, the amorphous metal alloys disclosed herein are particularly useful as coatings to form electrodes for halogen evolution processes, as set forth in U.S. Pat. No. 4,560,454 owned by the Assignee of record herein. Other uses as electrodes include the production of fluorine, chlorate, perchlorate and electrochemical fluorination of organic compounds. These alloys can also be employed as hydrogen permeable membranes.

BACKGROUND ART

The unique combination of properties possessed by amorphous metal alloy materials may be attributed to the disordered atomic structure of amorphous materials which ensures that the material is chemically homogeneous and free from the extended defects that are known to limit the performance of crystalline materials.

Generally, amorphous materials are formed by rapidly cooling the material from a molten state. Such cooling occurs at rates on the order of $10^{6°}$ C./second. Processes that provide such cooling rates include sputtering, vacuum evaporation, plasma spraying and direct quenching from the liquid state. Direct quenching from the liquid state has found the greatest commercial successes inasmuch as a variety of alloys are known that can be manufactured by this technique in various forms such as thin films, ribbons and wires.

U.S. Pat. No. 3,856,513 describes novel metal alloy compositions obtained by direct quenching from the melt and includes a general discussion of this process. The patent describes magnetic amorphous metal alloys formed by subjecting the alloy composition to rapid cooling from a temperature above its melting temperature. A stream of the molten metal was directed into the nip of rotating double rolls maintained at room temperature. The quenched metal, obtained in the form of a ribbon, was substantially amorphous as indicated by X-ray diffraction measurements, was ductile, and had a tensile strength of about 350,000 psi (2415 MPa).

U.S. Pat. No. 4,036,638 describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibited high mechanical hardness and ductility.

The amorphous metal alloys described hereinabove have not been suggested for usage as electrodes in electrolytic processes in distinction from the alloys utilized for practice of the present invention. With respect to processes for chlorine evolution from sodium chloride solutions, certain palladium-phosphorus based metal alloys have been prepared and described in U.S. Pat. No. 4,339,270 which discloses a variety of ternary amorphous metal alloys consisting of 10 to 40 atomic percent phosphorus and/or silicon and 90 to 60 atomic percent of two or more of palladium, rhodium and platinum. Additional elements that can be present include titanium, zirconium, niobium, tantalum and/or iridium. The alloys can be used as electrodes for electrolysis and the patent reports high corrosion resistance in the electrolysis of halide solutions.

The anodic characteristic of these alloys have been studied by three of the patentees, M. Hara, K. Hashimoto and T. Masumoto and reported in various journals. One such publication entitled "The Anodic Polarization Behavior of Amorphous Pd-Ti-P Alloys in NaCl Solutions" *Electrochimica Acta,* 25, pp. 1215–1220 (1980) describes the reaction of palladium chips and phosphorus at elevated temperatures to form palladium phosphide which is then melted with titanium. The resulting alloy was then formed into ribbons 10 to 30 microns in thickness by the rotating wheel method.

"Anodic Characteristics of Amorphous Ternary Palladium-Phosphorus Alloys Containing Ruthenium, Rhodium, Iridium, or Platinum in a Hot Concentrated Sodium Chloride Solution", reported in the *Journal of Applied Electrochemistry* 13, pp. 295–306 (1983) describes the entitled alloys, again prepared by the rotating wheel method from the molten state. Palladium-silicon alloys were also prepared and evaluated but were found to be unsatisfactory as anodes. The reported anode alloys were found to be more corrosion resistant and had a higher chlorine activity and lower oxygen activity than DSA.

Lastly, "Anodic Characteristics of Amorphous Palladium-Iridium-Phosphorus Alloys in a Hot Concentrated Sodium Chloride Solution" reported in *Journal of Non-Crystalline Solids,* 54, pp. 85–100 (1983) describes such alloys also prepared by the rotating wheel method. Again, moderate corrosion resistance, high chlorine activity and low oxygen activity were reported.

The authors found that the electrocatalytic selectively of these alloys was significantly higher than that of the known dimensionally stable anodes (DSA) consisting of an oxide mixture of ruthenium and titanium supported by metallic titanium. A disadvantage of DSA is that the electrolysis of sodium chloride is not entirely selective for chlorine and some oxygen is produced. The alloys reported were less active for oxygen evolution than DSA.

U.K. patent application No. 2,023,177A discloses eleven different classes of so-called amorphous matrix coating materials and indicates that they could have utility as electrodes. One of the classes comprises metallic glasses such as borides, nitrides, carbides, silicides and phosphides of iron, calcium, titanium, zirconium and the like. These alloys have high corrosion rates making them unsuitable for use as anodes in electrolytic processes.

Dimensionally stable anodes are described in the following three early U.S. patents. U.S. Pat. No. 3,234,110 calls for an electrode comprising titanium or a titanium alloy core, coated at least partially with titanium oxide which coating is, in turn, provided with a noble metal coating such as platinum, rhodium, iridium and alloys thereof.

U.S Pat No. 3,236,756 discloses an electrode comprising a titanium core, a porous coating thereon of platinum and/or rhodium and a layer of titanium oxide on the core at the places where the coating is porous.

U.S. Pat. No. 3,771,385 is directed toward electrodes comprising a core of a film forming metal consisting of titanium, tantalum, zirconium, niobium and tungsten, carrying an outside layer of a metal oxide of at least one platinum metal from the group consisting of platinum, iridium, rhodium, palladium, ruthenium and osmium.

All three of these electrodes have utility in electrolytic processes although unlike the anodes of the present invention, none employ amorphous metals. Thus, despite the state of the art in amorphous metal alloys, there has not been a teaching heretofore of the use of iridium based amorphous metal alloys as coatings to form anodes in halogen evolution processes. The specific alloys disclosed herein are extremely corrosion resistant and substantially 100 percent selective to chlorine.

SUMMARY OF THE INVENTION

An anode of the present invention comprises a substrate material and an iridium based amorphous metal alloy as a coating thereon. The amorphous alloy has the formula $$Ir_iD_dE_eF_f \qquad \text{I}$$

where

D is Ti, Zr, Nb, Ta, Ru, W, Mo and mixtures thereof;
E is C, B, Si, P, Al, Ge, As, N, Sb and mixtures thereof;
F is Rh, Pt, Pd and mixtures thereof;
i is from about 35 to 96 percent;
d is from about 0 to 40 percent;
e is from about 4 to 40 percent;
f is from about 0 to 45 percent; with the provisos that $i+d+e+f=100$ and if E is Si and/or P, then B is also present.

The anode has a corrosion rate of less than 10 microns/-year as measured in a 1 to 4M NaCl solution at a current density of between about 100 to 300 mA/cm$^2$.

Another anode comprises a substrate material and an iridium based amorphous metal alloy as a coating thereon. The alloy has the formula $$Ir_iY_yD_dE_eF_f \qquad \text{II}$$

where

Y is yllrium; D is Ti, Zr, Nb, Ta, Ru, W, Mo and mixtures thereof;
E is C, B, Si, P, Al, Ge, As, N, Sb and mixtures thereof;
F is Rh, Pt, Pd and mixtures thereof;
i is from about 50 to 96 percent;
y is from about 4 to 40 percent;
d is from about 0 to 40 percent;
e is from about 4 to 40 percent;
f is from about 0 to 45 percent; with the provisos that $i+y+d+e+f=100$ and if E is Si and/or P, then B is also present.

This anode also has a corrosion rate of less than 10 microns/year in a 1 to 4M NaCl solution at a current density of between about 100 to 300 mA/cm$^2$.

The present invention further provides for the use of the foregoing amorphous metal alloys as anodes in a process for the electrolysis of halide-containing electrolyte solutions. Such a process comprises the step of conducting electrolysis of the halide-containing solutions in an electrolytic cell having an iridium based amorphous metal anode of the formula $$Ir_iD_dE_eF_f \qquad \text{I}$$

as described hereinabove.

A similar process is also provided for the generation of halogens from halide-containing solutions which comprises the step of conducting electrolysis of the solutions in an electrolytic cell having an iridium based amorphous metal anode of the formula $$Ir_iY_yD_dE_eF_f \qquad \text{II}$$

as described hereinabove.

PREFERRED MODE FOR CARRYING OUT THE INVENTION

In accordance with the present invention, anodes comprising a substrate material and iridium based amorphous metal alloys are provided having the formulae $$Ir_iD_dE_eF_f \qquad \text{I}$$

and $$Ir_iY_yD_dE_eF_f \qquad \text{II}$$

as described hereinabove. The metal alloys can be binary or ternary, in the former instance certain ternary elements are optional. The use of the phrase "amorphous metal alloys" herein refers to amorphous metal-containing alloys that may also comprise one or more of the foregoing non-metallic elements. Amorphous metal alloys may thus include nonmetallic elements such as boron, silicon, phosphorus and carbon. Several preferred combination of elements within formula I include Ir/B; Ir/P, Ir/B/P; Ir/B/Ti; Ir/B/C; Ir/B;Si; Ir/B/Pt; Ir/B/Rh; Ir/B/Pd; Ir/Pd/Ta/Pt and Ir/Pd/Pt/Ta/B. Preferred combinations within formula II include Ir/Y; Ir/Y/Pd and Ir/Y/Ti. The foregoing list is not to be construed as limiting but merely exemplary.

As part of this invention, it has been discovered that differences in the corrosion resistance and electrochemical properties exist between the crystalline and amorphous phases of these alloys. For example, different overpotential characteristics for oxygen, chlorine and hydrogen evolution, differences in the underpotential electrochemical absorption of hydrogen and corrosion resistance under anodic bias, have all been observed and reported in the aforementioned copending applications.

Unlike existing amorphous metal alloys known in the art, the alloys employed herein are not palladium based, although palladium can be present as a minor component. Moreover, being amorphous, the alloys are not restricted to a particular geometry, or to eutetic compositions.

Several of the amorphous metal alloys of the present invention are novel in part because the relative amounts of the component elements are unique. Existing amorphous alloys have either not contained the identical elements or have not contained the same atomic percentages thereof. It is believed that the electrochemical activity and corrosion resistance which characterize these alloys are attributable to the unique combination of elements and their respective amounts. Others have been prepared heretofore but have not been employed as coatings over substrates to form anodes. In no instance have any of these alloys been employed directly as anodes in electrolytic processes for the generation of halogens.

All of the alloys can be prepared by any of the standard techniques for fabricating amorphous metal alloys. Thus, any physical or chemical method, such as evaporation, chemical and/or physical decomposition, ion-cluster electron-beam or sputtering process can be utilized. The amorphous alloy can be either solid, powder or thin film form, either free standing or attached to a substrate. Trace impurities such as O, N, S, Se, Te and Ar are not expected to be seriously detrimental to the preparation and performance of the materials. The only restriction on the environment in which the materials are prepared or operated is that the temperature during both stages be lower than the crystallization temperature of the amorphous metal alloy.

The anodes of the present invention comprise the amorphous metal alloys as coatings on substrate materials which can be employed in various electrochemical processes for the generation of halogens. At least one preferred substrate for use as an electrode is titanium although other metals such as zirconium, niobium, tantalum and hafnium based metals and various nonmetals are also suitable depending upon intended uses. The substrate is useful primarily to provide support for the amorphous metal alloys and therefore can also be a nonconductor or semi-conductor material. The coating is readily deposited upon the substrate by sputtering, as is exemplified hereinbelow. Coating thicknesses are not crucial and may range broadly, for example, up to about 100 microns although a preferred thickness is less than 10 microns. Other thicknesses are not necessarily precluded so long as they are practical for their intended use. A useful thickness, exemplified in the work hereinbelow, is 3000 Å.

As will be appreciated, the desired thickness is somewhat dependent upon the process of preparation of the electrode and somewhat upon the intended use. Thus, a free-standing or non-supported electrode, as prepared by liquid quenching, may have a thickness of approximately 100 microns. Or an amorphous alloy electrode can be prepared by pressing the amorphous alloy, in powder form, into a predetermined shape and can also be thick enough to be free-standing. Where a sputtering process is employed, relatively thin layers can be deposited and these would be preferably supported by a suitable substrate, as noted hereinabove. Thus, it is to be understood that the actual electrode of the present invention is the amorphous metal alloy whether supported or unsupported. Where a very thin layer is employed, a support may be convenient or even necessary to provide integrity.

Irrespective of the use of the amorphous metal alloys, as a coating or a solid product, the alloys are substantially amorphous. The term "substantially" as used herein in reference to the amorphous metal alloy means that the metal alloys are at least fifty percent amorphous. Preferably the metal alloy is at least eight percent amorphous and most preferably about one hundred percent amorphous, as indicated by X-ray diffraction analysis.

The present invention also provides a process for the generation of halogens from halide-containing solutions which employs the amorphous metal alloys described herein as anodes. One such process includes the step of conducting electrolysis of the halide-containing solutions in an electrolytic cell having an iridium based amorphous metal anode selected from the group consisting of $$Ir_iD_dE_eF_f \qquad \text{I}$$

$$Ir_iY_yD_dE_eF_f \qquad \text{II}$$

alloys as described hereinabove. The difference in the two processes is solely in the compositions of iridium based amorphous metal anodes employed in each.

A specific reaction that can occur at the anode in the process for chlorine evolution is as follows:

$$2Cl^- - 2e^- \rightarrow Cl_2$$

Similarly, at the cathode the corresponding reaction can be but is not necessarily limited to:

$$2H_2O + 2e^- \rightarrow H_2 + 2OH^-$$

As stated hereinabove, the amorphous metal alloys employed herein are substantially 100 percent selective to chlorine as compared to about 97 percent for DSA materials. This increased activity has two significant consequences. First, the chlorine evolution efficiency (per unit electrical energy input) is almost 100 percent, an improvement of about 3 percent or better. Second, separation steps may be obviated due to the negligible oxygen content.

As will be appreciated by those skilled in the art a wide variety of halide-containing solutions can be substituted for sodium chloride such as, for instance, potassium chloride, lithium chloride, cesium chloride, hydrogen chloride, iron chloride, zinc chloride, copper chloride and the like. Products in addition to chlorine can also include, for instance, chlorates, perchlorates and other chlorine oxides. Similarly, other halides can be present, in lieu of chlorides, and thus, other products generated. The present invention is, therefore, not limited by use in any specific halide-containing solution.

The process of electrolysis can be conducted at standard conditions known to those skilled in the art. These include temperatures between about 0° to 100° C. with about 60° to 90° C. being preferred; voltages in the range of from about 1.10 to 1.7 volts (SCE) and, current densities of from about 10 to 2000 mA/cm$^2$, with about 100 to 300 mA/cm$^2$ being preferred. Electrolyte solutions (aqueous) are generally at a pH of 1.0 to 8.0 and molar concentrations of from about 0.5 to 4M. The cell configuration is not crucial to practice of the process and therefore is not a limitation of the present invention.

In the examples which follow, 17 iridium based amorphous metal alloy anodes were prepared via radio frequency sputtering in argon gas. A 2"Research S-Gun, manufactured by Sputtered Films, Inc. was employed.

As is known, DC sputtering can also be employed. For each of the examples, a titanium substrate was positioned to receive the deposition of the sputtered amorphous alloy. The distance between the target and the substrate is each instance was approximately 10 cm. The composition of each alloy was verified by X-ray analysis and was amorphous thereto.

TABLE I

| Amorphous Metal Alloy Halogen Anodes | |
|---|---|
| Example No. | Alloy |
| 1 | $Ir_{70}B_{30}$ |
| 2 | $Ir_{70}B_{20}P_{10}$ |
| 3 | $Ir_{50}B_{25}Ti_{25}$ |
| 4 | $Ir_{65}B_{20}Ti_{15}$ |
| 5 | $Ir_{65}B_{10}Ti_{25}$ |
| 6 | $Ir_{70}B_{20}Si_{10}$ |
| 7 | $Ir_{70}B_{20}C_{10}$ |
| 8 | $Ir_{40}B_{20}Pt_{40}$ |
| 9 | $Ir_{55}B_{25}Pt_{20}$ |
| 10 | $Ir_{60}B_{25}Rh_{15}$ |
| 11 | $Ir_{35}B_{30}Pd_{35}$ |
| 12 | $Ir_{75}Y_{25}$ |
| 13 | $Ir_{55}Y_{25}Ti_{20}$ |
| 14 | $Ir_{55}Y_{25}Pd_{20}$ |
| 15 | $Ir_{40}Pd_{35}Ta_{20}Pt_{5}$ |
| 16 | $Ir_{50}Pd_{20}Pt_{5}Ta_{15}B_{10}$ |
| 17 | $Ir_{70}Pd_{10}Pt_{5}Ta_{10}B_{5}$ |

The 17 alloy anodes reported in Table I were each separately employed in a 4M NaCl solution for the evolution of chlorine when an anodic bias was applied in the solution. Electrolysis was conducted at 80° to 90° C. ph 4 at a current density at 200 mA/cm$^2$. Voltages were recorded and corrosion rates for each alloy were determined and are presented in Table II, hereinbelow.

TABLE II

| Iridium Based Anodes for the Generation of Chlorine | | |
|---|---|---|
| Ex. No. | Voltage (SCE) at 200 mA/cm$^2$ | Corrosion Rate (microns/year) |
| 1 | 1.17 | 2.2 |
| 2 | 1.17 | 0.8 |
| 3 | 1.19 | 0.05 |
| 4 | 1.17 | 0.03 |
| 5 | 1.14 | 0.08 |
| 6 | 1.19 | 1.2 |
| 7 | 1.19 | 0.9 |
| 8 | 1.21 | 0.03 |
| 9 | 1.20 | 0.08 |
| 10 | 1.19 | 0.02 |
| 11 | 1.20 | 10.15 |
| 12 | 1.22 | 6.8 |
| 13 | 1.19 | 0.8 |
| 14 | 1.19 | 1.5 |
| 15[a] | 1.19 | 0.05 |
| 16[a] | 1.18 | 0.10 |
| 17[a] | 1.18 | 0.03 |

[a]90° C.

In order to demonstrate the superior corrosion resistance exhibited by the alloy anodes of the present invention, corrosion rates were determined for five different anodes for comparison. The anodes compared included: palladium; an amorphous Pd/Si alloy and an amorphous Pf/Ir/Rh/P alloy, both reported by Hara, et al, a DSA reported by Novak, et al and an amorphous Pd/Ir/Ti/P alloy reported by Hara, et al but prepared by the manner set forth hereinabove. Respective corrosion rates of these anodes at 100 A/m$^2$ in 4M NaCl at 80° C. and pH 4 were measured and are presented in Table III, hereinbelow.

TABLE III

| Corrosion Rates | |
|---|---|
| Anode Material | Corrosion Rate Microns/Year |
| Pd | >100,000 |
| a-$Pd_{(80)}Si_{(20)}$[a] | >100,000 |
| a-$Pd_{(41)}Ir_{(30)}Rh_{(10)}P_{(19)}$[b] | 4 |
| DSA[c] | 0.31 |
| a-$Pd_{(40)}Ir_{(30)}Ti_{(10)}P_{(20)}$[d] | 12.4 |

[a]Hara, et al, Journal of Applied Electrochemistry, 13, p. 295 (1983)
[b]Hara, et al, Journal of Non-Crystalline Solids, 54, pp. 85 (1983)
[c]D. Novak, B. Tilak, B. Conway, Modern Aspects of Electrochemistry, Chapt. 4 (1983)
[d]Sputtered 2000 Å film The data reported for the a-$Pd_{(80)}Si_{(20)}$ anode was estimated from polarization data given relative to Pd. The a-$Pd_{(41)}Ir_{(30)}Rh_{(10)}P_{(19)}$ anode was the most corrosion resistant material as reported in the *Journal of Non-Crystalline Solids.* As can be seen from Table III, 15 of the amorphous metal alloy anodes of this invention were found to possess significantly better corrosion rates than any of the known anode materials.

Chlorine selectivity was measured for the electrode of Example No. 15 and was found to be 97–100%. Substituting a DSA, chlorine selectivity was found to be 92–94%. Conditions for both measurements included 4M NaCl; pH 2.0; temperature 70° C. and current density of 250 mA/cm$^2$. Thus, the use of the amorphous metal alloys discussed herein, in the process of the present invention provides greater utility in terms of chlorine selectivity.

In order to demonstrate the poor corrosion resistance of other alloys known in the art containing silicon, boron, nitrogen or phosphorus, four amorphous metal alloys, outside of the present invention were prepared. The formula for each alloy is within the scope of GB 2,023,177A discussed in the Background.

The corrosion rate of each amorphous metal electrode was examined at 84° C. in 4M NaCl at pH 4.2, which was adjusted by addition of HCl. A current density of 50 mA/cm$^2$ was used and the potential of the electrode was monitored against a SCE reference electrode. A graphite rod was employed as a counter electrode. At the current density employed, no chlorine evolution was observed on any of the electrodes. The data is presented in Table IV.

TABLE IV

| Corrosion Rates of Other Amorphous Alloys | | |
|---|---|---|
| Anode Material | | |
| $Fe_{80}Si_6B_{14}$ | Initial weight | 13.36 mg |
| | Thickness | 50 microns |
| | Initial E° | 0.32 V vs SCE |
| | Time to Total Corrosion | 702 sec |
| | Corrosion rate | $2.24 \times 10^3$ mm/yr |
| $Cr_{40}Ni_{33}Fe_7P_{12}B_8$ | Initial weight | 15.52 mg |
| | Thickness | 30 microns |
| | Initial E° | −0.009 V vs SCE |
| | Time to Total Corrosion | 726 sec |
| | Corrosion rate | $1.30 \times 10^3$ mm/yr |
| $Fe_{80}B_{20}$ | Initial Thickness | 2000 Å |
| | Initial E° | −0.095 V vs SCE |
| | Time to Total Conversion | 8 sec |
| | Corrosion rate | $7.88 \times 10^2$ mm/yr |
| $Fe_{78}Mo_2B_{20}$ | Initial Thickness | 2000 Å |
| | Initial E° | 0.225 V vs SCE |
| | Time to Total Conversion | 15 sec |

TABLE IV-continued

| Corrosion Rates of Other Amorphous Alloys | |
|---|---|
| Anode Material | |
| Corrosion rate | $4.20 \times 10^2$ mm/yr |

Corrosion rates observed were on the order of meters per year which is unacceptably high as compared against an acceptable value of several microns per year. The Applicants anodes possess a corrosion rate of less than 10 microns per year as measured under commercial chlorine/chlorate conditions which include the following: pH<8.0; temperature about 60° to 90° C.; concentration between 1 to 4M NaCl and current density between 100 to 500 mA/cm$^2$.

Thus, the foregoing examples demonstrate anodes comprising coatings of iridium based amorphous metal alloys on substrates and the use of these alloys as electrodes in halogen generation processes. Although the alloys disclosed herein were prepared by a sputtering technique which is a useful means for depositing the alloy onto a metal substrate such as titanium, it is to be understood that neither the process of sputtering nor the coating of substrates are to be construed as limitations of the present invention, inasmuch as the alloys can be prepared by other processes and have other forms. Similarly, the composition of the amorphous metal alloys of the present invention can be varied within the scope of the total specification disclosure and therefore neither the particular components nor the relative amounts thereof in the alloys exemplified herein shall be construed as limitations of the invention.

Furthermore, while, the amorphous metal anodes exemplified herein have been utilized in conjunction with a process for the evolution of chlorine gas from sodium chloride solutions such as brine and sea water, it will readily be appreciated by those skilled in the art that other chlorine containing compounds could also be produced via known electrolysis techniques by substituting the amorphous metal anodes of the present invention for the conventional DSA materials or other electrodes. Similarly, other halide-containing electrolyte solutions could be substituted for the sodium chloride reported herein with a variety of products being obtained. Moreover, these anodes could find utility in processes employing any other conventional electrolytic cell.

Thus, it is believed that any of the variables disclosed herein can readily be determined and controlled without departing from the spirit of the invention herein disclosed and described. Moreover, the scope of the invention shall include all modifications and variations that fall within the scope of the attached claims and is not to be limited by the examples and related data set forth herein. These have been provided merely to demonstrate the preparation and amorphous nature of the alloys.

We claim:

1. An anode comprising:

a substrate material; and an iridium based amorphous metal alloy coating on said substrate having the formula $$Ir_iY_yD_dE_eF_f \qquad \text{II}$$

where

Y is yttriumi

D is Ti, Zr, Nb, Ta, Ru, W, Mo and mixtures thereof;

E is C, B, Si, P, Al, Ge, As, N, Sb and mixtures thereof;

F is Rh, Pt, Pd and mixtures thereof;

i is from about 50 to 96 percent;

y is from about 4 to 40 percent;

d is from about 0 to 40 percent;

e is from about 4 to 40 percent;

f is from about 0 to 45 percent;

with the provisos that i+y+d+e+f=100 and if E is Si and/or P, then B is also present;

said anode having a corrosion rate of less than 10 microns/year as measured in a 1 to 4M NaCl solution at a current density of from about 100 to 300 mA/cm$^2$.

2. An anode, as set forth in claim 1, wherein said amorphous metal alloy is at least 60 percent amorphous.

3. An anode, as set forth in claim 1, wherein said amorphous metal alloys is about 100 percent amorphous.

4. An anode, as set forth in claim 1, comprising Ir and Y.

5. An anode, as set forth in claim 4, comprising $Ir_{75}Y_{25}$.

6. An anode, as set forth in claim 1, comprising Ir, Y and Ti.

7. An anode, as set forth in claim 6, comprising $Ir_{55}Y_{25}Ti_{20}$.

8. An anode, as set forth in claim 1, comprising Ir, Y and Pd.

9. An anode, as set forth in claim 8, comprising $Ir_{55}Y_{25}Pd_{20}$.

10. An anode, as set forth in claim 1, wherein said substrate is titanium.

11. An anode, as set forth in claim 10, wherein the thickness of said amorphous metal alloy deposited on said substrate is about 3000 Å.

12. An anode, as set forth in claim 1, produced by radio frequency sputtering.

13. An anode, as set forth in claim 1, produced by D.C. sputtering.

14. An anode, as set forth in claim 1, produced by electron beam evaporation.

15. An anode, as set forth in claim 1, produced by liquid quenching.

16. An anode, as set forth in claim 1, produced by ion plating.

17. A process for the generation of halogens from halide-containing solutions comprising the step of:

conducting electrolysis of said solutions in an electrolytic cell having an iridium based amorphous metal anode selected from the group consisting of $Ir_iY_yD_dE_eF_f$ alloys where Y is yttriumi D is Ti, Zr, Nb, Ta, Ru, W, Mo and mixtures thereof;

E is C, B, Si, P, Al, Ge, As, N, Sb and mixtures thereof;

F is Rh, Pt, Pd and mixtures thereof;

i is from about 50 to 96 percent;

y is from about 4 to 40 percent;

d is from about 0 to 40 percent;

e is from about 4 to 40 percent;

f is from about 0 to 45 percent; with the provisos that i+y+d+e+f=100 and if E is Si and/or P, then B is also present.

18. A process, as set forth in claim 17, wherein electrolysis is conducted at a voltage range of from about 1.10 to 1.70 and current densities of from about 10 to 2000 mA/cm$^2$.

19. A process, as set forth in claim 17, wherein said halide is chloride.

20. A process, as set forth in claim 19, which produces products selected from the group consisting of chlorine, chlorates, perchlorates and other chlorine oxides upon electrolysis of said halide-containing solutions therewith.

21. A process, as set forth in claim 17, wherein said halide-containing solution comprises sodium chloride solutions.

22. A process, as set forth in claim 21, wherein chlorine is generated at said anode substantially free of oxygen.

* * * * *